US006227361B1

(12) United States Patent
Salazar et al.

(10) Patent No.: US 6,227,361 B1
(45) Date of Patent: May 8, 2001

(54) CARRYING CASE FOR COMMUNICATION DEVICES

(76) Inventors: Donilee Grabb Salazar, 3365 Sansome Ct., Santa Rosa, CA (US) 95403; Cinder Marquis, 3080 Branding Iron Rd., Bozeman, MT (US) 59715

( * ) Notice: Subject to any disclaimer, the term of this patent is extended or adjusted under 35 U.S.C. 154(b) by 0 days.

(21) Appl. No.: 09/371,703

(22) Filed: Aug. 9, 1999

(51) Int. Cl.[7] ..... B65D 85/00
(52) U.S. Cl. ..... 206/305; 224/666; 224/674
(58) Field of Search ..... 206/305, 320; 181/156; 310/81; 224/665, 666, 674

(56) References Cited

U.S. PATENT DOCUMENTS 4,348,842 * 9/1982 Wilkinson ..... 52/166
4,564,894 * 1/1986 Gonzalez ..... 362/398
5,261,583 * 11/1993 Long et al. ..... 206/305
5,629,502 * 5/1997 Nakano ..... 181/156
5,713,466 * 2/1998 Tajima ..... 206/320
5,835,006 * 11/1998 Michalak et al. ..... 310/81

OTHER PUBLICATIONS

Brochure Entitled "Phone Sox".

* cited by examiner

*Primary Examiner*—Jim Foster
(74) *Attorney, Agent, or Firm*—Glenn W. Rhodes; Howrey Simon Arnold & White, LLP

(57) ABSTRACT

A carrying case for portable communication devices employing vibrations to signal incoming messages or calls is disclosed. The case includes within it an exterior facing metallic member and an interior facing retaining member. The retaining member urges the communication device against the metallic portion, thereby aiding in transmitting the vibrations from the interior of the carrying case to the exterior of the carrying case to enhance the ability of the user to detect the vibration signally an incoming message or call.

15 Claims, 3 Drawing Sheets

CARRYING CASE FOR COMMUNICATION DEVICES

FIELD OF THE INVENTION

The present invention relates to carrying cases for communication devices, and more particularly to cases for communication devices employing vibrating signaling devices to alert the user to incoming messages or calls and for protection of all electronic devices being held.

BACKGROUND OF THE INVENTION

A variety of carrying cases for communication devices exist in the market since the popularity of portable communication devices has increased. These are in addition to traditional carrying cases such as purses, bags, briefcases and the like. For example, a variety of carrying cases have been designed for carrying cellular phones, pagers and other types of portable communication devices that are dimensioned to hold the communication device, and perhaps a few accessory items.

While these types of carrying cases are adequate for communication devices using audible alarm devices to signal an incoming messages or calls, they are generally inadequate for communication devices that use inaudible signaling means for notifying the user of an incoming message or call. For example, an increasing number of users use communication devices that vibrate as the means to signal an incoming message. Such devices are less intrusive than traditional audible devices in meetings, restaurants and similar environments where audible devices are undesirable. However, traditional containers, such as purses or other types of specialized communication device cases tend to mask the vibration intended to alert the user of an incoming message or call. Accordingly, the user may miss an incoming message or call. Moreover, without a case, the communication device is inconvenient to carry and is subjected to damage from dropping, bumping or banging the device.

Thus, a need exists for a device that allows the user to easily carry a portable communication device, while providing improvements in transmitting the vibrations to the user of the communication device, adding protection to the product being carried.

SUMMARY OF THE INVENTION

The present invention addresses the problems associated with traditional carrying cases used for holding communication devices that employ vibrations to alert the user to incoming messages or calls. The carrying case of the present invention employs a metallic component to assist in transmitting the vibration from the interior of the carrying case to the outside of the carrying case such that the user is more easily alerted to the incoming signal. The metallic member is used in conjunction with a retaining member that urges the communication device against the metallic member.

One advantage of the present invention is the ease in which the metallic member can be incorporated into the liner of a carrying case. Another feature of the present invention is the increased protection to the communication device afforded by the metallic component. An additional feature of the present invention is the use of the metallic component to retain the shape of the carrying case.

Additional features and advantages of the present invention will be apparent form the drawings and the following detailed description of the invention.

DETAILED DESCRIPTION OF THE INVENTION

Figure 1:
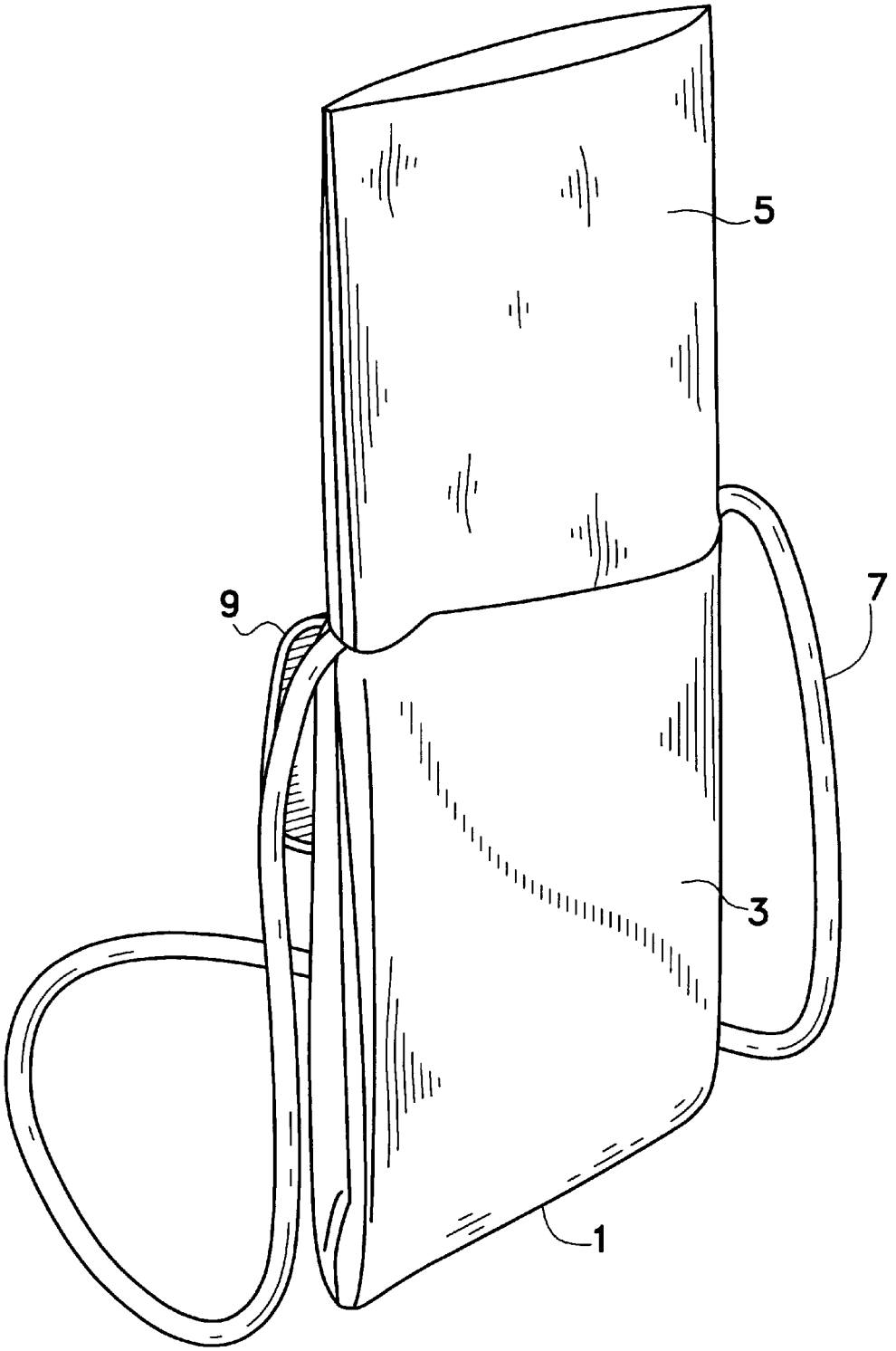
FIG. 1 is a perspective view illustration of one embodiment of the invention showing the exterior material portion and interior-lining portion of the carrying case.

The present invention is directed to carrying cases for communication devices that employ vibrations to alert the user to incoming messages or calls, as well as to provide protection.

Traditional carrying cases for communication devices such as cellular phones, pagers and the like tend to mask the vibration used to alert users of incoming calls and messages. The present invention employs a metallic member inserted into the carrying case and a retaining member adapted to urge a communication device employing a vibrating signal against the metallic member. Urging the communication device against the metallic member serves to enhance the resonation of the frequency of the vibration such that the vibration is felt more readily by the carrier of the communication device, while also adding protection to product being carried.

There is no particular limitation on the design of the carrying case. It is sufficient that the design allow for the transmission of the vibration from the interior of the case to the exterior of the case such that the vibration can be detected by the user of the case. For example, the case may be a purse having an interior portion adapted to carry the communication device. The portion of the purse carrying the communication device will have a metallic member positioned between the exterior of the purse and the communication device. A retaining member is employed to urge the communication device against the metallic member. When an incoming signal is received, thereby activating the vibrator, the vibration is transmitted via the metallic member from the interior of the case to the exterior of the case where the user of the communication device is more likely to detect the vibration. For example, purses are often carried over the shoulder and rest against the body of the user. In the present invention, a purse so designed will readily transmit the vibration caused by activation of the communication device from the interior of the purse to the exterior of the purse so that the vibration can be detected where the purse rests against the body of the user.

The type of metal employed as the vibration transmission medium should be a type that readily enhances the resonance of the vibration from the interior of the case to the exterior of the case. Such metals include copper, brass, aluminum, steel, brass, tin, galvanized tin, titanium, beryllium, magnesium and the like. A particularly preferred metal is 26, 28 or 30 gauge galvanized tin.

As indicated above, a metallic member is positioned in a carrying case such that it is positioned between the communication device and the exterior of the case. A retaining member is situated on the interior side of the case and spaced apart from the metallic member such that a communication device may be inserted between the metallic member and the retaining device. The retaining device urges the communication device against the metallic member such that vibrations resulting from an incoming signal are transmitted from the interior of the case to the exterior of the case. The retaining device may be of any type that will sufficiently hold the communication device against the metallic member such that the vibrations are transmitted from the interior of the case to the exterior of the case. Such retaining members may be one or more bands, clips, springs and the like that extend from one side of the metallic member around the communication device to the other end of the metallic member.

Figure 2:
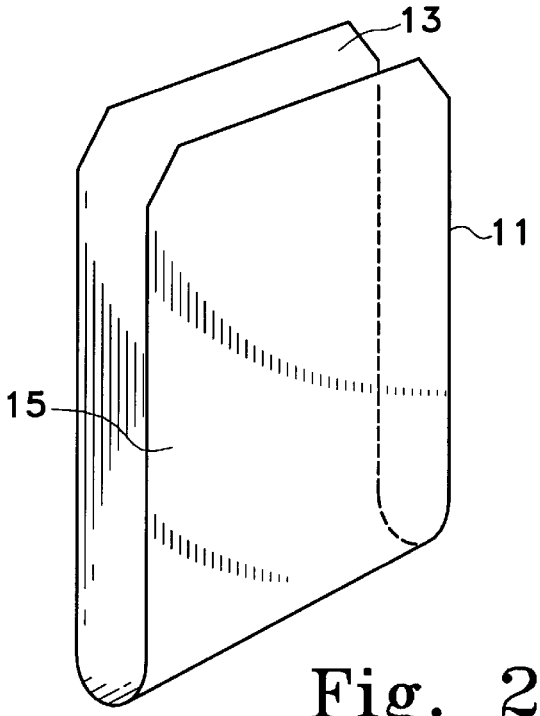
FIG. 2 is a perspective view illustration of a one-piece metallic member in accordance with one embodiment of the present invention.
Figure 3:
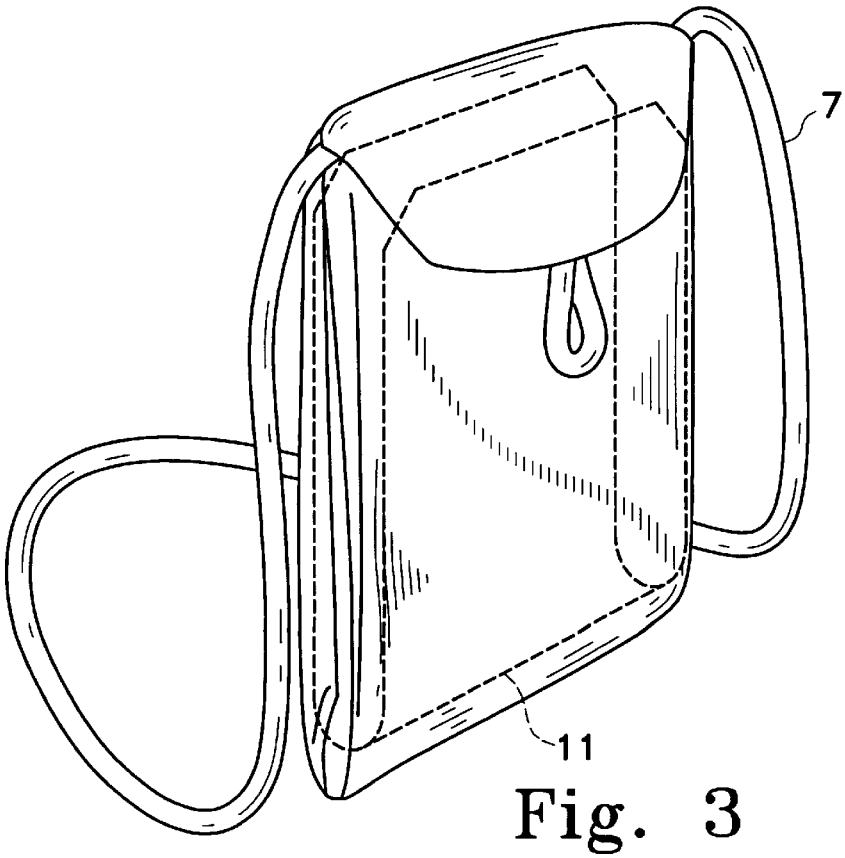
FIG. 3 is a perspective view of the one-piece metallic member of FIG. 2 inserted into the carrying case of FIG. 1.

In a preferred embodiment the metallic member and the retaining member are either paneled or formed from one piece. Referring to FIG. 1, a carrying case 1 is illustrated having an exterior material portion 3, and interior lining portion 5, and a carrying strap 7. Alternatively, a belt attachment member 9, such as a loop, hook or bracket may also be included for attaching the carrying case to a belt. Referring to FIG. 2, a one-piece metallic member 11 is illustrated. The one-piece metallic member is illustrated having an exterior facing portion 13 and an interior-facing portion 15. Referring to FIGS. 1 and 3, the one-piece metallic member may be inserted into the carrying case through an opening in the end of the interior lining portion 5 and positioned in the carrying case such that the metallic member is positioned next to the exterior material portion 3 as illustrated in FIG. 3. Ideally, the carrying case and the metallic member are similarly dimensioned. After insertion into the carrying case via the opening in the interior lining portion, the interior lining is pushed into the carrying case such that the metallic member is positioned between the exterior material portion and the interior-lining portion. The generally unshaped metallic member is dimensioned such that the communication device is in contact with both the interior and exterior facing portions of the metallic member. In the embodiment illustrated, the metallic member and retaining member form one piece or may be paneled, performing both the function of transmitting vibrations from the communication device to the exterior of the carrying case and retaining the communication device in contact with the metallic surfaces. In other words, the u-shaped metallic member urges the communication device against each other and both metallic surfaces transmit vibrations from the interior of the case to the exterior of the case.

Other similar embodiments are also contemplated. For example, the one-piece metallic member may form one part of a general carrying case, such as a purse, wherein the purse has a compartment, such as a sleeve or pouch, for carrying the communication device. In this embodiment, the exterior facing portion is positioned such that it is adjacent an exterior portion of the carrying case and the interior facing portion of the one-piece metallic member is facing the interior portion of the bag. In another embodiment, a generally unshaped metallic/retaining member may be formed wherein the exterior facing portion is composed of metal, and the interior retaining portion is formed of another material, such as plastic, and adapted to urge the communication device against the exterior metallic portion.

The material forming the exterior material portion of the carrying case may be of any suitable material that does not impede the transmission of the vibration from the interior of the case to the exterior of the case via the metallic member. For example, cloth materials are particularly preferred, as well as thinner leathers and such similar natural or synthetic materials.

Figure 4:
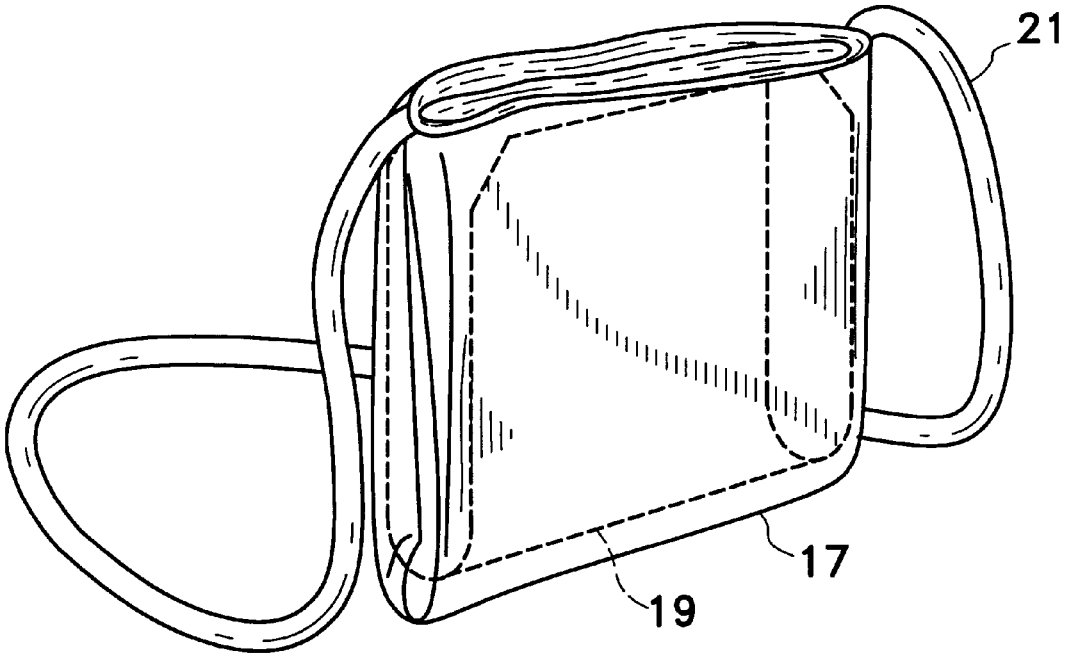
FIG. 4 is a perspective view of an alternative carrying case embodiment as illustrated in FIGS. 1–3.

The carrying cases may also be dimensioned in various sizes to accommodate difference communication devices. For example, as illustrated in FIG. 4, a carrying case 17 is illustrated that is dimensioned to accommodate a typical paging device. The metallic member 19 is similarly dimensioned to fit within the carrying case as previously illustrated in FIGS. 1 and 3, and dimensioned to fit a paging device within the one-piece metallic member. A strap 21 is attached for carrying the pager over the shoulder. In addition, an attachment member may also be included for attaching or clipping the case to a belt.

Numerous other variations and embodiments can be discerned from the above detailed description of the invention and illustrations thereof, and all such variations are encompassed within the scope and spirit of the present invention.

What is claimed is:

1. An apparatus, comprising:

(a) a metallic member;

(b) a retaining member sufficiently spaced apart from said metallic member to accommodate a communication device inserted between said metallic member and said retaining device such that said retaining member will urge said communication device against said metallic member; and (c) a carrying case having an interior and an exterior enclosing said metallic member and said retaining member such that vibrations from said metallic member will be transmitted from the interior of said case to the exterior of said case.

2. The apparatus of claim 1 wherein said metallic member comprises a metal selected from copper, brass, aluminum, stainless steel, brass, tin, galvanized tin, titanium, beryllium and magnesium.

3. The apparatus of claim 2 wherein said metallic member comprises galvanized tin.

4. The apparatus of claim 3 wherein said metallic member comprises galvanized tin of 26, 28 or 30 gauge.

5. The apparatus of claim 1 further comprising a material portion adjacent and exterior of said metallic member.

6. An apparatus, comprising:

(a) a vibration transmitting member having an exterior facing portion and an interior facing portion, said exterior facing portion comprising a metallic component and said interior facing portion spaced apart from said exterior facing portion and dimensioned to accommodate a communication device there between, said interior facing portion adapted to urge a communication device against said exterior facing portion; and (b) a carrying case having an interior and exterior and enclosing said vibration transmitting member; said carrying case correspondingly dimensioned to said vibration transmitting member such that vibrations from said vibration transmitting member are transmitted from the interior of the carrying case to the exterior of the carrying case.

7. The apparatus of claim 6 wherein said exterior facing portion comprises a metal selected from copper, brass, aluminum, stainless steel, brass, tin, galvanized tin, titanium, beryllium and magnesium.

8. The apparatus of claim 7 wherein said metallic member comprises galvanized tin.

9. The apparatus of claim 8 wherein said metallic member comprises galvanized tin of 26, 28 or 30 gauge.

10. An apparatus, comprising:

(a) A carrying case having an exterior material portion and an interior material portion;

(b) a metallic member disposed between said exterior material portion and said interior material portion;

(c) a retaining member spaced apart from said metallic member and adapted to urge a vibration against said metallic member, while also adding protection to the device.

11. The apparatus of claim 10 wherein said metallic member comprises a metal selected from copper, brass, aluminum, stainless steel, brass, tin, galvanized tin, titanium, beryllium and magnesium.

12. The apparatus of claim 11 wherein said metallic member comprises galvanized tin.

13. The apparatus of claim 12 wherein said metallic member comprises galvanized tin of 26, 28 or 30 gauge.

14. The apparatus of claim 10 wherein said metallic member and said retaining member comprise a generally unshaped one-piece metallic member disposed between said exterior material portion and said interior material portion, said metallic member dimensioned to accommodate a communication device there between and adapted to urge a communication device against said metallic member.

15. An apparatus, comprising:

(a) A carrying case having an exterior material portion and an interior material portion;

(b) a metallic member disposed between said exterior material portion and said interior material portion;

(c) a retaining member spaced apart from said metallic member and adapted to urge a vibration against said metallic member, said metallic member and said retaining member forming a generally u-shaped one-piece metallic member disposed between said exterior material portion and said interior material portion, said one-piece metallic member dimensioned to accommodate a communication device there between and adapted to urge a communication device against said metallic member.

* * * * *

UNITED STATES PATENT AND TRADEMARK OFFICE

CERTIFICATE OF CORRECTION

PATENT NO. : 6,227,361 B1
DATED : May 8, 2001
INVENTOR(S) : Donilee Grabb Salazar and Cinder Marquis It is certified that error appears in the above-identified patent and that said Letters Patent is hereby corrected as shown below:

Claim 14,
Line 13, change "unshaped" to -- u-shaped -- .

Signed and Sealed this

Eleventh Day of September, 2001

*Attest:*

Nicholas P. Godici

*Attesting Officer*

NICHOLAS P. GODICI
*Acting Director of the United States Patent and Trademark Office*